United States Patent [19]

De Mattheis

[11] Patent Number: 4,653,203

[45] Date of Patent: Mar. 31, 1987

[54] SKI BOOT STRUCTURE PARTICULARLY FOR DOWNHILL SKIING

[75] Inventor: Filippo De Mattheis, Teramo, Italy

[73] Assignee: Nordica S.p.A., Montebelluna, Italy

[21] Appl. No.: 791,232

[22] Filed: Oct. 25, 1985

[30] Foreign Application Priority Data

Oct. 31, 1984 [IT] Italy ..... 5241/84[U]

[51] Int. Cl.[4] ..... A43B 5/04; A63C 9/086

[52] U.S. Cl. ..... 36/117; 280/613

[58] Field of Search ..... 36/117–121; 280/613, 614

[56] References Cited

U.S. PATENT DOCUMENTS 3,606,368 9/1971 Smolka et al. ..... 280/613
3,695,623 10/1972 Covini ..... 280/613
3,834,723 9/1974 Erlebach ..... 36/117 X
3,869,136 3/1975 Jackson ..... 36/117 X
3,924,869 12/1975 Strub ..... 36/117 X
3,957,280 5/1976 Turnheim et al. ..... 280/613

*Primary Examiner*—James Kee Chi

*Attorney, Agent, or Firm*—Albert Josif; Guido Modiano

[57] ABSTRACT

The invention is concerned with a ski boot structure particularly intended for downhill skiing, which comprises a boot shell, a boot sole, and an inclinable boot quarter oscillably associated with the shell for oscillation relatively thereto; the sole has members for binding the ski boot to the body of a ski, which include at least three small plungers arranged to move coaxially within a guide internally of the sole against and by the action of a spring for snap engagement with binding blocks associated with the ski body.

13 Claims, 4 Drawing Figures

SKI BOOT STRUCTURE PARTICULARLY FOR DOWNHILL SKIING

BACKGROUND OF THE INVENTION

The present invention relates to a ski boot structure particularly for downhill skiing.

Known are ski boots which incorporate, internally of their soles or externally thereof, devices adapted for engagement with one or two binding members provided on the ski body.

Such prior devices usually comprise movable elements which engage with a snap action in recesses formed in the binding members owing to a pressure force exerted on said elements by elastic means, and specifically by spring means.

More in detail, the binding member's recesses wherein such movable elements engage, are provided on two opposed faces or areas of the binding member, and consequently, the movable members are located on opposed sides with respect to each other on the binding member itself.

With that binding structure, the binding member usually engages at a substantially central region of the boot and creates inherent problems due to the fact that all of the stresses resulting from the movements imparted to the ski by the skier while skiing are transferred through a single member, which makes it very difficult to calibrate the springs according to the skier's weight and skiing style or action, and according to the force required to release the ski from the boot in an optimum fashion in the event of the skier falling.

To compensate for these problems, bindings have been developed which have two binding members rigidly attached to the ski body, wherein the recesses to be engaged by the movable elements are arranged to confront one another in spaced apart relationship such that the forces brought about to control the skis directionally are divided between both binding members and the moment of force which resists the force tending to release the ski from the boot can be made greater, thereby the springs of the movable elements do not require to be calibrated for maximum values, which reflects favourably on the reliable release of the ski from the boot in the event of a fall.

However, the latter binding types, while improving considerably the possibility of meeting at one time both of the primary prerequisites of a ski binding for downhill skiing, namely a reliable release combined with a good ability to transfer the commands imparted to the skis by the skier, have the drawback that they cannot differentiate the forces imparted by the skier while skiing between the binding member which is closest to the boot toe end and the binding member closest to the boot heel region.

SUMMARY OF THE INVENTION

The aim underlying this invention is to obviate such prior drawbacks by providing a ski boot structure particularly for downhill skiing which can split the forces involved in securing the boot on a ski body in a different fashion.

Within the above aim, it is an important object of the invention to provide a ski boot structure whose members for hooking to a ski body provide an increased binding force close to the heel and a lesser one close to the boot toe.

Another object of the invention is to provide a ski boot structure which affords reliable releasing from a ski body in the event of the skier falling.

A not least object of the invention is to provide a ski boot structure having a sole which can be made shorter than the longitudinal extension of the boot shell in order to afford an improved ease of walking for the wearer.

The above aim, and these and other objects are achieved by a ski boot structure particularly for downhill skiing, comprising a boot shell, a boot sole, and a quarter associated oscillably with said shell, said sole having binding members for binding the boot on a ski body, characterized in that said binding members include at least three small plungers arranged to move coaxially within a guide internally of said sole against and by the action of elastic means for snap engagement with binding blocks associated with said ski body.

BRIEF DESCRIPTION OF THE DRAWINGS

Further features and advantages of the invention will become apparent from the following description of a preferred though not exclusive embodiment of the boot structure according to this invention, to be read in conjunction with the accompanying illustrative and not limitative drawings, where.

DESCRIPTION OF THE PREFERRED EMBODIMENTS

Figure 1:
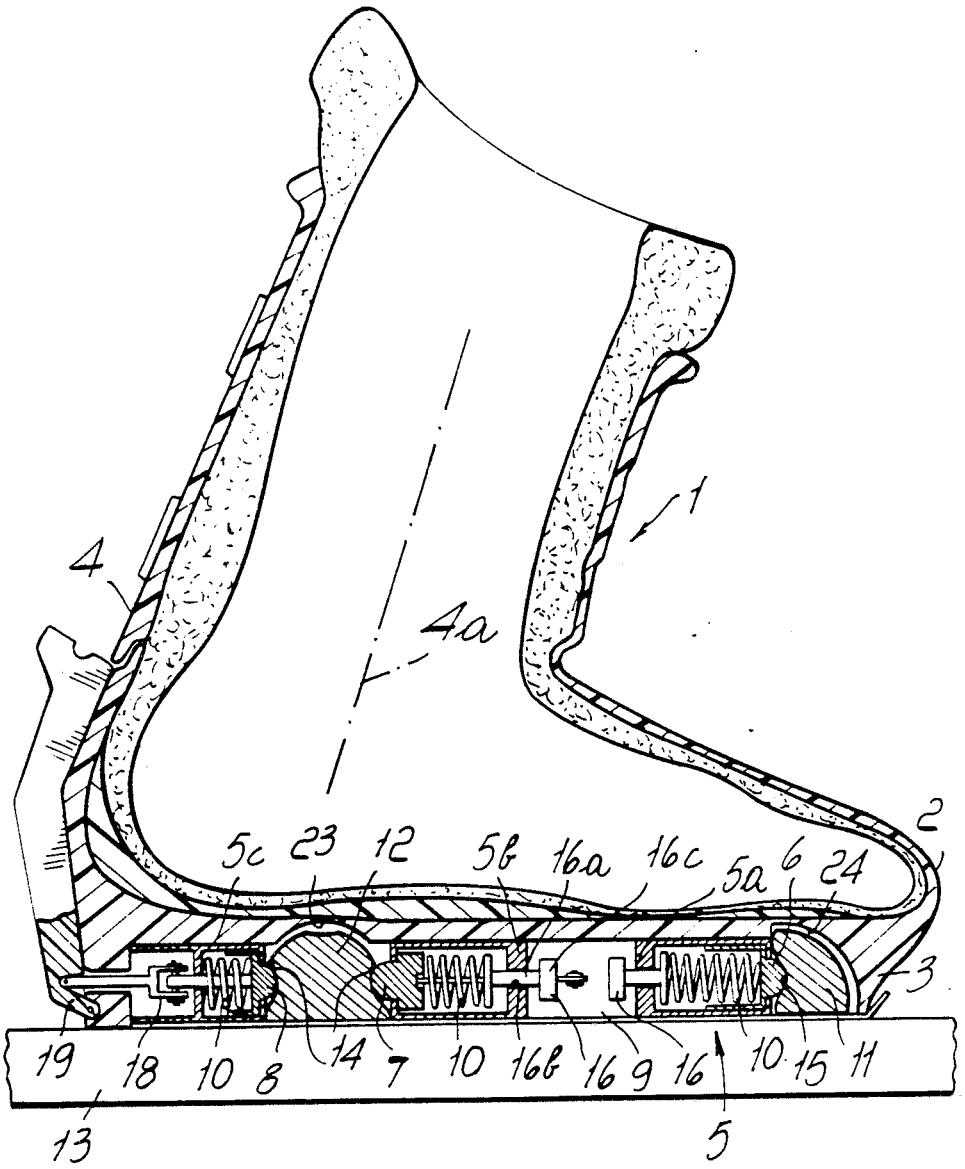
FIG. 1 is a partly sectional side elevation view of the boot structure showing the binding members of this invention inside the sole.
Figure 2:
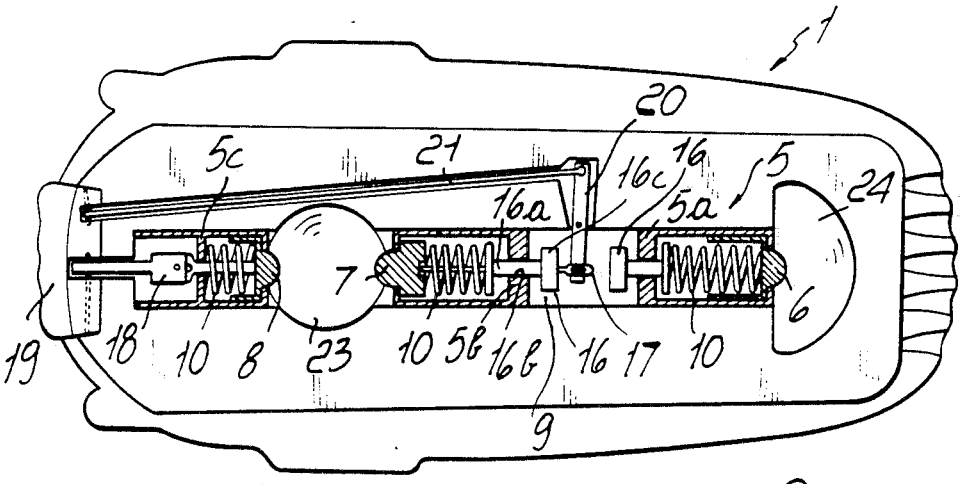
FIG. 2 is a partly sectional plan view of the sole of the boot structure according to the invention showing the inventive binding members.
Figure 3:
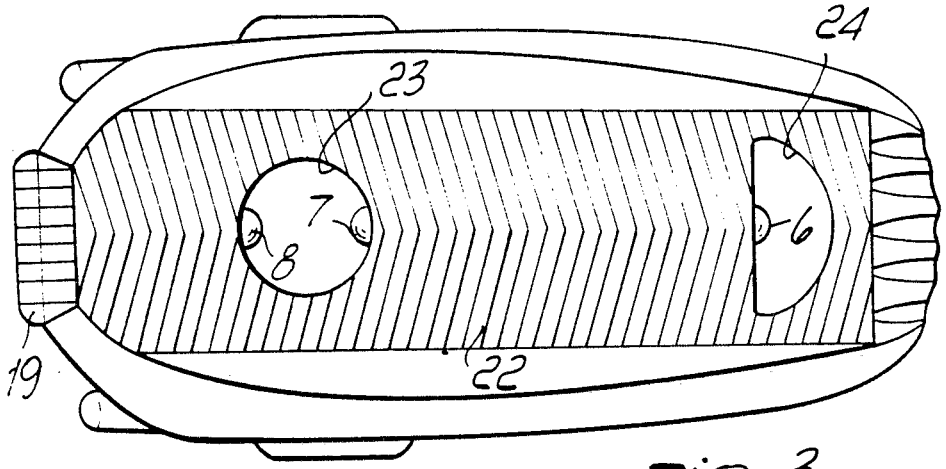
FIG. 3 is a bottom plan view of the cover element for the sole of the boot structure according to the invention.
Figure 4:
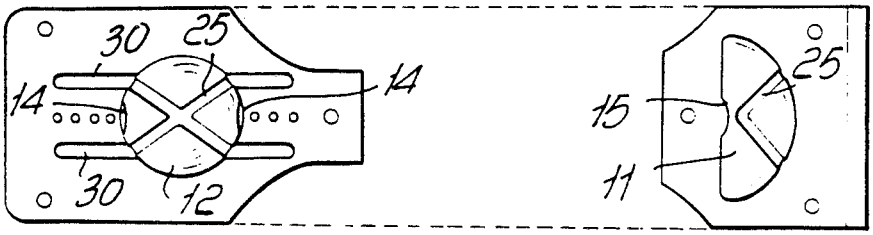
FIG. 4 is a plan view of the binding blocks associated with a ski body, according to the invention.

With reference to the drawing figures, a boot structure according to the invention, as generally designated with the reference numeral 1, comprises a shell 2 whereto a sole 3 is rigidly attached and an inclinable quarter 4 associated oscillably with the shell 2.

Advantageously, the sole 3 has internally mounted binding members, generally indicated at 5, which comprise at least three alined small plungers 6,7 and 8 arranged to move coaxially with respect to each other within a longitudinal cavity 9 against and by the action of elastic means, specifically springs 10, accommodated in housings 5*a*,5*b*,5*c*.

The heads of the plungers are adapted for snap engagement with first and second binding or holding blocks 11 and 12 respectively which are conveniently associated with the body of a ski 13.

The first plunger 7 and second plunger 8 form a pair of plungers arranged at a clamping distance from each other such that their end heads confront each other and have a rounded shape to snap engage in seats 14 provided in the binding or holding element 12 arranged near an axis 4*a* coaxial with the axis of the tibia bone of the user as visible from FIG. 1.

Likewise, the third plunger 6 has a rounded terminating head adapted to engage in a seat 15 provided in the binding element 11.

It should be also pointed out that said small plungers 6,7 and 8 each have a tubular adjustment element 16, comprising an externally threaded stem 16*a*, threadably engaging a correspondingly threaded seat 16*b*, provided in the housings 5*a–c*, and having an enlarged extremity or thumb-wheel 16*c*, the rotation whereof causes the threaded portion to move the end of the spring 10 towards or away from the plunger 5,6,7 and is thus effective to calibrate the force exerted by the springs 10 according to the skier's requirements.

The binding members 5 also have associated therewith a lever system for moving the plungers 6,7 and 8 manually, and which specifically comprises a first rod 17 passing through a tubular adjustment element 16 and being rigidly associated with the first plunger 7 and a second rod 18, rigidly associated with the second plunger 8, passing through an adjustment element 16 and having the opposed end thereof pivotally associated with a release lever 19 connected pivotally to the sole 2 proximately to the skier's heel.

Obviously, calibration of the force exerted by the springs 10 in the housings 5*b*,5*c* could also be achieved by providing a thread engagement relationship between the rods 17,18 and the interior of the stem 16*a* of the adjustment element 16, and permitting the latter to slide in the seat 16*b* provided in the housings.

The first rod 17 has its free end journalled to one end of a small plate or link 20, in turn journalled to the sole 3, the opposed end of said plate being journalled to a first end of a bar 21 the other end whereof is pivotally connected to said release lever 19, so as to produce, on turning the release lever 19, simultaneous displacements of the plungers 7 and 8 in opposite directions and hence disengage the heads of the plungers from the binding element 12 and allow, therefore, the boot and accordingly the binding members associated therewith, to be separated from the ski body.

In order to prevent the binding members from suffering damage due to dirt or foreign matter as the skier walks over snow-covered or clear ground, the sole 2 is advantageously provided with a cover element 22 having a circular opening 23 at the heads of the plungers 7 and 8 and a semicircular opening 24 at the plunger 6, adapted to define areas wherein the binding elements 11 and 12 are insertable.

Merely by way of example, it is further pointed out that the seats 14 of the binding element 12 are located diametrically opposed to each other and coaxial with the seat 15 in the binding element 11.

In order then that any snow deposits may not hinder hooking on the binding blocks 11 and 12, the latter have on their rounded surfaces small channels 25 effective to eject such deposits during their insertion through the respective circular and semicircular openings, since the latter have substantially the same size as the binding block 11 and 12.

Conveniently, the binding block 12 is slideably movable along a guide 30, such that it can be moved towards and away from the binding block 11 according to the boot's size and therefore, the sizes of the hooking members provided in the sole.

It has been ascertained in practice that the ski boot structure according to the invention is particularly advantageous in that it provides the skier with hooking members which have three small plungers, two of which, namely the plunger 7 and plunger 8, are in practice located close to the heel region of the skier's foot, in which region the greatest stresses are transferred between the boot and ski body, while providing on the binding block 11, i.e. close to the toe of the boot where stresses are much lower, a lower binding force effective to facilitate a possible release of the boot from the ski body in the event of the skier falling.

The invention herein is susceptible to many modifications and changes without department from the scope of the inventive concept; furthermore, all of the details are replaceable with technically equivalent elements. In practicing the invention, any suitable materials and dimensions may be used contingent on requirements and the state of the art.

I claim:

1. A ski boot structure particularly for downhill skiing, comprising a boot shell, a boot sole with a longitudinal cavity provided therein and a quarter associated with said shell, said sole having binding means for binding the boot on a ski body by engagement with at least a first and at least a second holding element secured on said ski body, said binding means comprising at least three alined plunger members axially spaced apart from each other and contained within said longitudinal cavity internal to said sole for coaxial movement with respect to each other within limits within said cavity, at least two of said plunger members forming a pair of cooperating oppositelly arranged plunger members facing each other at a clamping distance from each other to snap engage in use therebetween said first holding member and at least a third of said plunger members arranged at a distance from said pair of plunger members for engagement with said second holding element, each of said plunger members having elastic means cooperating therewith for urging said plunger members in clamping positions thereof.

2. A ski boot according to claim 1, wherein said elastic means comprise each a housing and a spring arranged therein and in engagement with one end thereof with a respective plunger member to urge said respective plunger member in a clamping position thereof, said elastic means further comprising an adjustment member in engagement with another end of said spring and having an actuation portion thereof extending outside said housing for controlling the adjustment of the spring action.

3. A ski boot according to claim 2, wherein said adjustment member is a threaded stem and wherein said housing comprises a threaded seat in screwing engagement with said threaded stem for obtaining the adjustment motion of said stem upon rotation thereof.

4. A ski boot according to claim 1, further comprising means for manually moving at least said two plunger members of said pair of plunger members, said means including an actuation lever hinged at the outside of said sole and an articulated link system within said sole and connected with at least said two plunger members of said pair of plunger members to move said two plungers member selectively away or alterantively towards each other.

5. A ski boot according to claim 4, wherein said articulated link system comprises a first rod connected with one end thereof with one of said two plunger members of said pair of plunger members which is nearer to said actuation lever than another of said two plunger membersa and with the other end thereof hingedly connected with said actuation lever, a transvers link member hinged on said sole in an intermediate point thereof and extending transverse to said plunger members and having one end thereof hinged to said another of said two plunger members of said pair of plungers and a bar hinged with one end thereof to another end of said transverse link member, said bar having another end thereof hinged to said actuation lever.

6. A ski boot according to claim 1, wherein said sole has a covering element comprising a first aperture for said first holding element to pass therethrough and a secondo aperture for said second holding element to pass therethrough.

7. A ski boot according to claim 1, wherein said pair of plunger members is arranged near an axis coaxial with the axis of the user's tibia.

8. In a binding structure for the ski boot according to claim 1, said first holding element in the form of a first block haing diametrically opposite seats for snap engagement with said pair of plungers and said second holding element in the form of a second block having a second seat for a snap engagement with said third plunger.

9. A binding structure according to claim 8, wherein said first and said second blocks have generally a rounded configuration and including surface channels formed thereon for favoring ejection of snow.

10. A binding structure according to claim 8, further comprising a guide arranged to be fixed on a ski body and wherein at least one of said first and said second blocks is adjustably fixed on said guide allowing slidable adjustment movement thereof.

11. A ski boot structure particularly for downhill skiing, comprising a boot shell, a boot sole with a longitudinal cavity provided therein and a quarter associated with said shell, said sole having binding means for binding the boot on a ski body by engagement with at least a first and at least a second holding element secured on said ski body, said binding means comprising at least three alined plunger members axially spaced apart from each other and contained within said longitudinal cavity internal to said sole for coaxial movement with respect to each other within limits within said cavity, at least two of said plunger members forming a pair of cooperating oppositelly arranged plunger members facing each other at a clamping distance from each other to snap engage in use therebetween said first holding member and at least a third of said plunger members arranged at a distance from said pair of plunger members for engagement with said second holding element, each of said plunger members having elastic means cooperating therewith for urging said plunger members in clamping positions thereof, wherein said elastic means comprise each a housing and a spring arranged therein and in engagement with one end thereof with a respective plunger member to urge said respective plunger member in a clamping position thereof, said elastic means further comprising an adjustment member in engagement with another end of said spring and having an actuation portion thereof extending outside said housing for controlling the adjustment of the spring action, wherein said adjustment member is a threaded stem and wherein said housing comprises a threaded seat in screwing engagement with said threaded stem for obtaining the adjustment motion of said stem upon rotation thereof, the device further comprising means for manually moving at least said two plunger members of said pair of plunger members, said means including an actuation lever hinged at the outside of said sole and an articulated link system within said sole and connected with at least said two plunger members of said pair of plunger members to move said two plungers member selectively away or alterantively towards each other.

12. A ski boot according to claim 11, wherein said articulated link system comprises a first rod connected with one end thereof with one of said two plunger members of said pair of plunger members which is nearer to said actuation lever than another of said two plunger membersa and with the other end thereof hingedly connected with said actuation lever, a transvers link member hinged on said sole in an intermediate point thereof and extending transverse to said plunger members and having one end thereof hinged to said another of said two plunger members of said pair of plungers and a bar hinged with one end thereof to another end of said transverse link member, said bar having another end thereof hinged to said actuation lever.

13. A ski boot according to claim 11, wherein said pair of plunger members is arranged near an axis coaxial with the axis of the user's tibia.

* * * * *